US005419147A

United States Patent [19]

Cooper

[11] Patent Number: 5,419,147

[45] Date of Patent: May 30, 1995

[54] AIR CONDITIONING EFFICIENCY

[76] Inventor: William G. Cooper, 3907 Valley Green Ct., Houston, Tex. 77059

[21] Appl. No.: 166,128

[22] Filed: Dec. 13, 1993

[51] Int. Cl.[6] ..... C03B 11/00

[52] U.S. Cl. ..... 62/171; 62/181; 62/305

[58] Field of Search ..... 62/171, 305, 181

[56] References Cited

U.S. PATENT DOCUMENTS

| | | | |
|---|---|---|---|
| 3,613,392 | 10/1971 | Tucci | 62/305 X |
| 4,028,906 | 6/1977 | Gingold et al. | 62/305 X |
| 4,274,266 | 6/1981 | Shires | 62/171 |
| 4,672,817 | 6/1987 | Croce | 62/305 X |
| 5,285,651 | 2/1994 | Marine | 62/171 |

*Primary Examiner*—William E. Wayner
*Attorney, Agent, or Firm*—John R. Casperson

[57] ABSTRACT

Disclosed is a method for reducing the temperature of the air passing over the condenser surface of an air conditioner unit, thereby reducing the power requirements of the unit. The method is carried out by applying water to the condenser surface to achieve coverage of substantially the entire outside surface and the entire inside surface of the condenser with water while the unit is operating. The amount of water applied should be sufficient to wet substantially the entire inside and outside surface of the condenser. The water can be applied from a tubing having a plurality of passages opening through its sidewall at generally linearly spaced apart positions. An adjustable valve means can be positioned near the inlet end of the tubing to regulate water flow through the tubing. An electrically actuated on-off valve can be operatively connected to the tubing between the adjustable valve and the passages so that water will flow only when the compressor is operating.

5 Claims, 2 Drawing Sheets

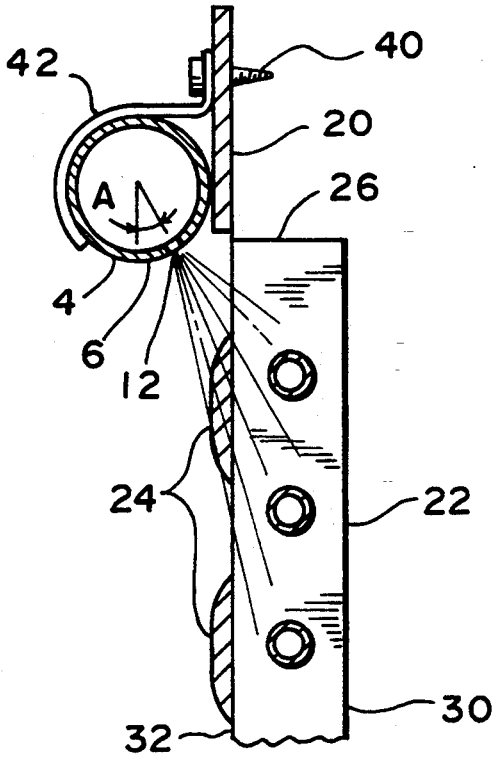
FIG. 3
FIG. 4
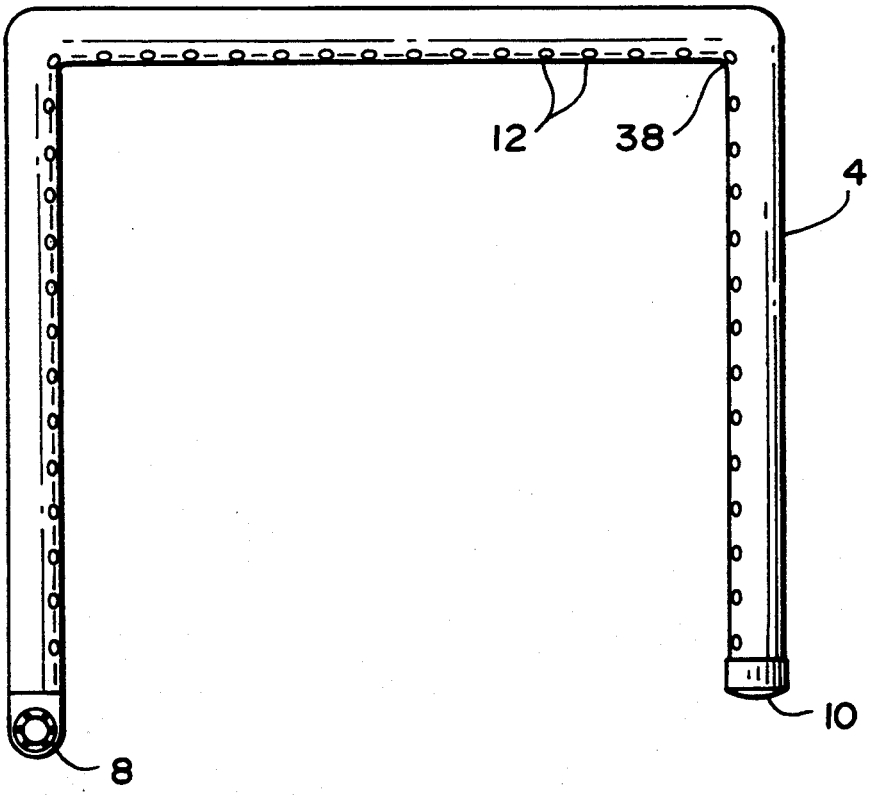

AIR CONDITIONING EFFICIENCY

BACKGROUND OF THE INVENTION

This invention relates to air conditioning. In one aspect, this invention relates to the operation of air conditioning condensers.

Most air conditioning systems use freon as the refrigerant. Most systems include an external air cooled unit connected to an internal air handling unit. The internal unit contains an evaporator coil. This evaporator/air handling unit is normally placed in the attic of residential homes. The external air cooled unit generally includes a refrigerant compressor which takes suction on the evaporator unit. The compressor compresses the refrigerant to a high discharge pressure. The refrigerant then enters an air cooled condenser where hot refrigerant gas is cooled and condensed to a liquid. The condenser is generally composed of coils that are placed in the outside walls of the housing containing the compressor. The condenser is constructed similar to the radiator of a car. Outside air is drawn over the coils by an electrically driven fan. The compressor is also electrically driven.

Power consumption is significantly impacted by outside temperatures. At higher temperatures, higher pressure is required to condense the refrigerant and the compressor must work harder. This is true regardless of the setting of the inside thermostat. A reduction in the temperature of the air passing over the condenser coil would reduce power consumption and thus would be very desirable.

OBJECTS OF THE INVENTION

It is an object of this invention to reduce the temperature of the air passing over the condenser coils in an air cooled condenser unit to reduce the discharge pressure required to condense the refrigerant.

It is another object of this invention to reduce the discharge pressure of an air conditioner compressor which will reduce power consumption and increase the service life of the compressor.

SUMMARY OF THE INVENTION

In one embodiment of the invention, there is provided a method for reducing condenser temperature in an air conditioner condenser. The method is carried out by applying a sufficient amount of water to the condenser to saturate and cool the air being drawn over the condenser surface. Generally, the water will be applied to wet substantially the entire outside surface and substantially the entire inside surface of the condenser when the compressor is operating.

The use of water will reduce the condensing temperature of the compressed refrigerant. This will in turn reduce the discharge pressure of the compressor and reduce the electrical energy required for operating the air conditioning system, regardless of the setting of the internal thermostat. The water can be applied to the outside of the condensing coils and as it combines with the air passing through the condensing coils substantially the entire surface of the condensing coils becomes water wet and cools the coils by conduction. Additional cooling compared to the air alone is provided by evaporative cooling.

In another embodiment of the invention there is provided apparatus which may be used to carry out the above process. In kit form, the apparatus comprises a fluid conductor, such as a tubular member having a plurality of outlet passages opening through its sidewall at generally linearly spaced apart positions. In a preferred embodiment, the tubular member can be formed from a tubing. An adjustable valve means is positioned near the inlet end of the tubular member to regulate water flow through the tubular member. An electrically actuated on-off valve is operatively connected to the tubular member between the adjustable valve and the passages.

Upon installation, the electrically operated valve can be electrically connected to the air conditioner control system so that water will flow only when the unit is operating. The tubing can be connected by a connector to a water supply and can be attached to the outside of the compressor housing with the passages directed toward the condenser coils to apply water to the coils. The adjustable valve provides means for regulating water flow for optimal economy.

BRIEF DESCRIPTION OF THE DRAWINGS

FIG. 3 is a cross sectional view of a portion of the apparatus shown in FIG. 1 illustrating certain details of the water distributer.

FIG. 4 is a bottom view of the water distributor shown in FIG. 1 illustrating certain additional details.

DETAILED DESCRIPTION OF THE PREFERRED EMBODIMENTS

Figure 1:
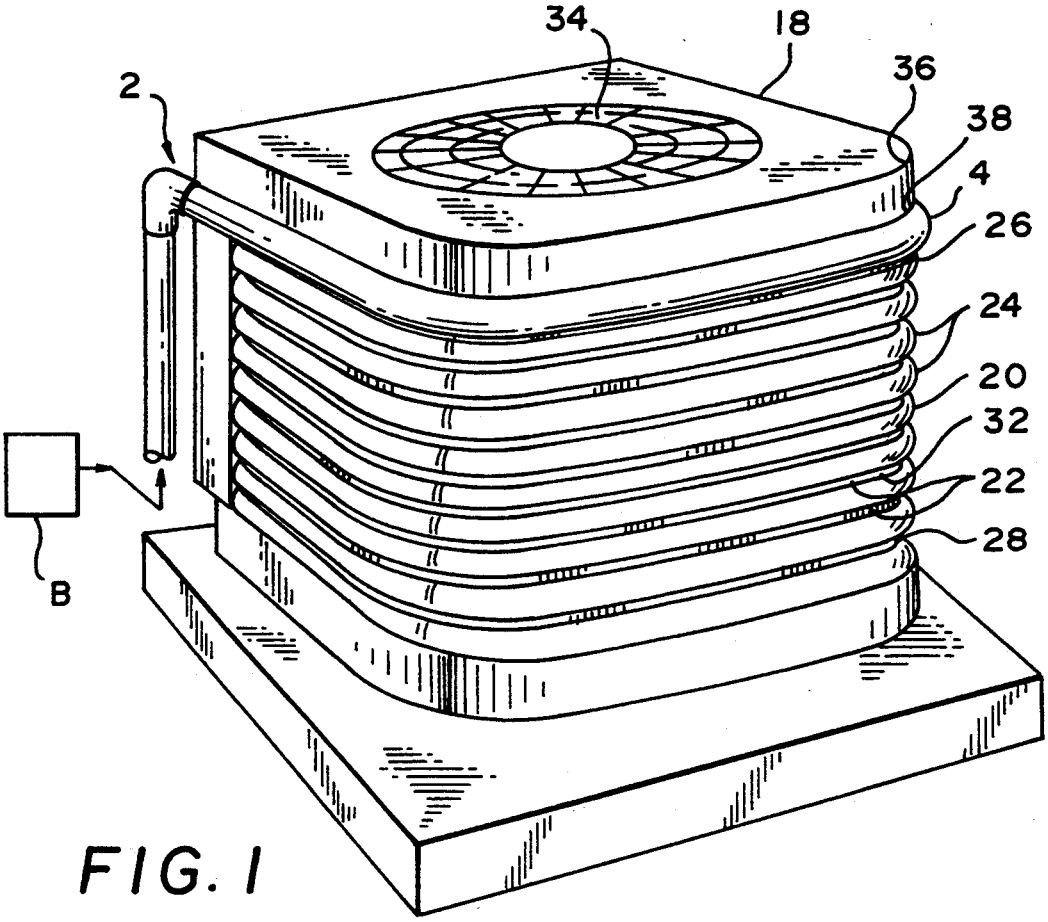
FIG. 1 is a pictorial representation, partly in schematic, illustrating certain features of one embodiment of the invention wherein a water distributor is positioned on an air conditioner condenser unit.
Figure 2:
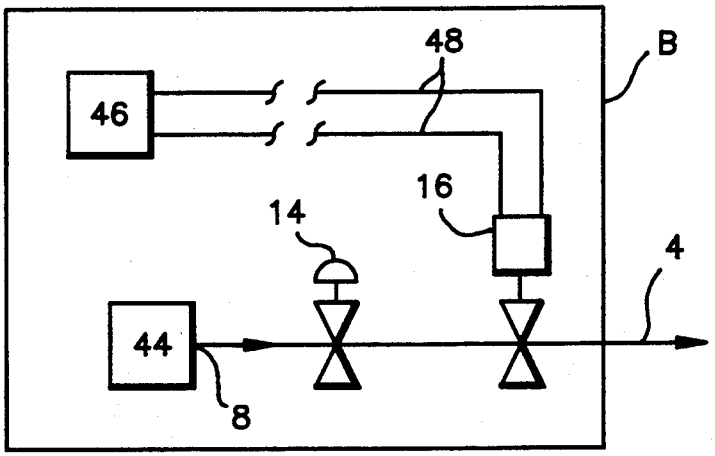
FIG. 2 is a schematic illustration of additional features of a portion of the apparatus shown in FIG. 1 as Box B.

An apparatus 2 according to one embodiment of the invention comprises a tubular member 4. The tubular member 4 is defined by a sidewall 6. The tubular member 4 has an inlet end 8 forming an inlet, a second closed end 10, a length, and a plurality of passages 12 forming outlets opening through the sidewall 6 at spaced apart positions. Preferably, the passages are positioned along a line extending along at least a portion of the length of the tubular member. The passages 12 are spaced apart from the inlet end 8 of the tubular member 4. The tubing can be formed from any desired material, such as copper, aluminum or polyvinyl chloride.

An adjustable valve means 14 is positioned near the inlet end 8 of the tubular member 4. The adjustable valve means 14 regulates fluid flow through the tubular member. An electrically actuated on-off valve 16 is operatively connected to the tubular member 4 between the adjustable valve 14 and the passages 12.

The device just described can be sold in kit form to home handymen or to air conditioner manufacturers. It is used on an air conditioner condenser unit 18 defined by a housing 20 containing a condenser coil. Usually, the housing 20 will include a condenser guard, such as members 24. The condenser 22 is visible in FIG. 1 between the guard members 24. The condenser 22 has an upper end 26, a lower end 28, an inside surface 30, and an outside surface 32. The Figure illustrates a condenser having coils positioned in three walls, although it is to be understood that coils can be positioned in all four walls of a box-shaped housing or all around the sidewall of a cylindrical housing. The housing 20 generally further contains a fan 34 to draw air from the outside surface 32 of the condenser coil 22 to the inside surface 30 of the condenser coil 22 and exhaust the air through the top of the housing. The tubular member 4 is positioned adjacent to the outside surface 32 of the condenser coil 22 and the passages 12 through the sidewall of the tubular member 4 are directed toward the outside surface 32 of the condenser coil 22.

Usually, condenser coils are positioned along the periphery of the housing. In box housings, the coils are generally in two or more of the vertical walls. In cylindrical housings, the coils extend along the periphery for at least a portion of the circumference of the housing. Where the housing 20 has a outside perimeter and bends, the condenser coil will usually contain at least one bend to extend at least partially around the perimeter of the housing. Sometimes, separate coils are positioned along each wall. When the housing has a bend 36 the tubular member contains at least one bend 38 to match and continue to extend alongside the condenser coil 22.

In a preferred embodiment of the invention, the tubular member 4 is positioned adjacent to the upper end 26 of the condenser coil 22. In the illustrated embodiment, the tubular member 22 is mounted to the housing 20 by a suitable fastener such as screw 40 and clamp 42 although the tubular member could be fastened to the coil guard if desired such as by wire or plastic ties. The tubular member 4 is attached to the housing 20 so that the passages through the sidewall of the tubular member are oriented toward the condenser. In the illustrated embodiment, the passages 12 are defined by boreholes oriented radially with respect to the tubular member at an angle A in the range of about 5 degrees to about 85 degrees with respect to the straight down vertical. Preferably, the angle A is in the range of from about 10 degrees to about 60 degrees from the vertical. More preferably, the angle A is in the range of from about 20 degrees to about 45 degrees from the vertical.

To complete installation, a source 44 of water is connected to the inlet of the tubular member. The water supply for the building served by the unit is highly suitable. The electrically actuated on-off valve 16 is preferably of the solenoid type. For maximum economy the water is only admitted to the tubular member when the compressor is operating. In one embodiment of the invention, a thermostat 46 is electrically connected via lines 48 to the electrically actuated on-off valve 16 to actuate the electrically actuated on-off valve and provide water flow to the tubular member when the compressor is operating in response to an electric signal from the thermostat. The electric signal could be obtained directly or indirectly from the thermostat inside of the building, from the compressor relay switch, for example, or the electric signal could be obtained from a temperature sensor on the hot refrigerant line from the condenser. If desired, however, water flow to the tubular member could be continuous but would not be as economical.

In operation of the invention, there is provided a method for reducing condenser temperature in an air conditioner condenser having an inside surface and an outside surface. The method is carried out by applying water to the outside surface of the condenser so that substantially the entire outside surface and substantially the entire inside surface of the condenser becomes water wet. The amount of water used should preferably be sufficient to produce a slight run-off, to mitigate solids buildup on the condenser.

In a preferred embodiment of the invention, the water is sprayed onto the outside surface of the condenser, preferably substantially the entire outside surface. Preferably, the water is applied from a water distributor attached to the condenser housing or guard. A portion of the water is drawn onto the inside surface of the condenser by the fan. The lower portion of the condenser may be wetted by gravity drainage. The fan causes air to be drawn over substantially the entire water wet outside surface and water wet inside surface of the condenser, causing both conductive and evaporative cooling. This reduces the condensing temperature of the compressed refrigerant, thus in turn reducing the discharge pressure of the compressor and the electrical consumption required for operating the air conditioning system.

To conserve water, the amount of water should be adjusted to minimize water consumption, ie, the condenser should be operated just barely water wet for maximum economy. Water usage is further economized by applying the water only when the compressor is in operation. Preferably, the water is applied in response to a signal from a thermostat which indicates that the compressor is in operation.

CALCULATED EXAMPLE

The following calculated example is based on Freon 22 at a 40 degrees F. evaporator temperature, a 100 degrees F. condenser temperature; an air temperature of 95 degrees F., and a dew point of 78 degrees F.

The vapor pressure of Freon 22 at 40 degrees F. is 83.2 psia, at 78 degrees F. is 153.9 psia, and at 100 degrees F. is 210.6 psia. Without water cooling, the pressure difference across the compressor will be 127.4 psia. By adding water, the air is cooled to the dew point of 78 degrees F. Under this condition, the pressure difference across the compressor will be 70.7 psia. Therefore, the reduction in work done by the compressor will be about 45%. This reduction in work relates directly to a savings in energy consumption.

What is claimed is:

1. An apparatus comprising:

a tubular member defined by a sidewall, said tubular member having an inlet open end, a second closed end, a length, and a plurality of passages opening through the sidewall at spaced apart positions along a line extending along at least a portion of the length of the tubular member, said passages being spaced apart from the inlet end or the tubular member;

an adjustable valve means positioned near the inlet end of the tubular member to regulate water flow through the tubular member;

an electrically actuated on-off valve operatively connected to the tubular member between the adjustable valve and the passages;

a thermostat electrically connected to the electrically actuated on-off valve to actuate the electrically actuated on-off valve and provide water flow to the tubular member in response to an electric signal from the thermostat;

an air conditioner condenser unit defined by a housing having an outside surface and an outside perimeter, said housing containing a condenser coil having an upper end, a lower end, an inside surface, an outside surface and at least one bend to follow at least partially the perimeter of the housing; and a fan to draw air from the outside surface of the condenser coil to the inside surface of the condenser coil;

wherein the tubular member contains at least one bend, is attached to the outside surface of the housing and is positioned alongside the condenser coil; and wherein the passages through the sidewall of the tubular member are directed toward the outside surface of the condenser coil.

2. An apparatus as in claim 1 wherein the tubular member is positioned adjacent to the upper end of the condenser coil.

3. An apparatus as in claim 2 wherein the tubular member is mounted to the housing and the passages through the sidewall of the tubular member are defined by boreholes oriented radially with respect to the tubular member at an angle in the range of about 5 degrees to about 85 degrees with respect to the straight down vertical.

4. An apparatus as in claim 3 wherein the angle is in the range of from about 10 degrees to about 60 degrees from the vertical.

5. An apparatus as in claim 4 wherein the angle is in the range of from about 20 degrees to about 45 degrees from the vertical.

* * * * *